US006232026B1

(12) United States Patent
Lambert

(10) Patent No.: US 6,232,026 B1
(45) Date of Patent: May 15, 2001

(54) MAGNETIC CARRIER PARTICLES

(75) Inventor: Patrick M. Lambert, Rochester, NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/572,988

(22) Filed: May 17, 2000

(51) Int. Cl.[7] ..... G03G 13/22; G03G 9/10
(52) U.S. Cl. ..... 430/106.6; 430/108; 252/62.63
(58) Field of Search ..... 252/62.63; 430/108, 430/106.6, 122

(56) References Cited

U.S. PATENT DOCUMENTS

| | | | |
|---|---|---|---|
| 3,716,630 | 2/1973 | Shirk | 423/594 |
| 3,795,617 | 3/1974 | McCabe | 252/62.1 |
| 3,795,618 | 3/1974 | Kasper | 252/62.1 |
| 3,893,935 | 7/1975 | Jadwin et al. | 252/62.1 |
| 3,938,992 | 2/1976 | Jadwin et al. | 96/1 SD |
| 3,941,898 | 3/1976 | Sadamatsu et al. | 427/18 |
| 4,042,518 | 8/1977 | Jones | 252/62.6 |
| 4,076,857 | 2/1978 | Kasper et al. | 427/18 |
| 4,206,064 | 6/1980 | Kiuchi et al. | 430/106 |
| 4,385,823 | 5/1983 | Kasper et al. | 355/3 R |
| 4,473,029 | 9/1984 | Fritz et al. | 118/657 |
| 4,496,643 | 1/1985 | Wilson et al. | 430/110 |
| 4,531,832 | 7/1985 | Kroll et al. | 355/3 DD |
| 4,546,060 | 10/1985 | Miskinis et al. | 430/108 |
| 4,623,603 | 11/1986 | Iimura et al. | 430/108 |
| 4,764,445 | 8/1988 | Miskinis et al. | 430/108 |
| 4,833,060 | 5/1989 | Nair et al. | 430/137 |
| 4,855,205 | 8/1989 | Saha et al. | 430/106.6 |
| 4,855,206 | 8/1989 | Saha | 430/106.6 |
| 5,061,586 | 10/1991 | Saha et al. | 430/108 |
| 5,104,761 | 4/1992 | Saha et al. | 460/106.6 |
| 5,106,714 | 4/1992 | Saha et al. | 430/106.6 |
| 5,190,841 | 3/1993 | Saha et al. | 430/106.6 |
| 5,190,842 | 3/1993 | Saha et al. | 430/106.6 |
| 5,212,038 | 5/1993 | Watanabe et al. | 430/122 |
| 5,256,513 | 10/1993 | Kawamura et al. | 430/106.6 |
| 5,268,249 | 12/1993 | Saha et al. | 430/106.6 |
| 5,306,592 | 4/1994 | Saha | 430/137 |
| 5,318,873 | 6/1994 | Kawamura et al. | 430/122 |
| 5,332,645 | 7/1994 | Saha et al. | 430/137 |
| 5,376,492 | 12/1994 | Stelter et al. | 430/122 |
| 5,424,160 | 6/1995 | Smith et al. | 430/108 |
| 5,496,674 | 3/1996 | Adel et al. | 430/106.6 |
| 5,500,320 | 3/1996 | Saha | 430/106.6 |
| 5,512,403 | 4/1996 | Tyagi et al. | 430/106.6 |
| 5,515,404 | 5/1996 | Pearce | 376/371 |
| 5,532,096 | 7/1996 | Maruta et al. | 430/108 |
| 5,614,346 | 3/1997 | Adel et al. | 430/106.6 |
| 5,710,965 | 1/1998 | Nozawa et al. | 399/313 |
| 5,737,677 | 4/1998 | Tombs et al. | 399/296 |
| 5,795,692 | 8/1998 | Lewis | 430/106.6 |
| 5,855,206 | 1/1999 | Ireland | 128/844 |
| 5,989,767 * | 11/1999 | Yoerger et al. | 430/108 |
| 5,998,076 | 12/1999 | Mahabadi et al. | 430/106.6 |
| 6,040,103 | 3/2000 | Ohno et al. | 430/110 |

FOREIGN PATENT DOCUMENTS

| | | | |
|---|---|---|---|
| 0 003 905 A1 | 9/1979 | (EP) | C08J/3/02 |
| 0 086 445 A1 | 8/1983 | (EP) | H01F/1/36 |
| 1 501 065 | 2/1978 | (GB) | G03G/9/08 |

OTHER PUBLICATIONS

"Magnetic Materials", B. D. Cullity, published by Addison–Wesley Pub. Co. 1972, pp. 18–23.

"Spray Drying", by K. Masters, published by Leonard Hill Books, London, pp. 502–509.

"Ferromagnetic Materials", Val. 3, edited by E. P. Wohlfarth, published by North–Halland Pat Co. Amsterdan p. 315 et seq.

Research Disclsoure, No. 21030, vol. 210, Oct. 1981 (published by Industrial opportunities Ltd., Homewell, Havant, Hampshire, P09 1EF, United Kingdom).

* cited by examiner

*Primary Examiner*—John Goodrow
(74) *Attorney, Agent, or Firm*—John L. Wood

(57) ABSTRACT

Conductive hard magnetic carrier particles are disclosed which contain a single-phase hexagonal crystal structure doped with at least one metal that, upon substitution of said metal into said crystal structure, produces a multi-valent ion of the formula $M^{n+}$, wherein n=4, 5, or 6. The carrier particles are useful in making developers for the development of electrostatic latent image patterns in an electrographic process. Also disclosed are methods for using such carrier particles in an electrographic process. Such carriers can display levels of conductivity such that the development efficiency, i.e., speed, of an electrographic process is improved.

62 Claims, No Drawings

MAGNETIC CARRIER PARTICLES

CROSS REFERENCE TO RELATED APPLICATIONS

Attention is directed to application U.S. Ser. No. 09/572,989 filed on May 17, 2000 entitled "MAGNETIC CARRIER PARTICLES"; and U.S. Ser. No. 60/204,941 filed on May 17, 2000 entitled "METHODS FOR USING HARD MAGNETIC CARRIERS IN AN ELECTROGRAPHIC PROCESS", the disclosures of which are incorporated by reference herein in their entirety.

BACKGROUND OF THE INVENTION

This invention relates to electrography and more particularly it relates to magnetic carrier particles and developers for the dry development of electrostatic charge images.

In electrography, an electrostatic charge image is formed on a dielectric surface, typically the surface of the photoconductive recording element. Development of this image is typically achieved by contacting it with a two-component developer comprising a mixture of pigmented resinous particles, known as toner, and magnetically attractable particles, known as carrier. The carrier particles serve as sites against which the non-magnetic toner particles can impinge and thereby acquire a triboelectric charge opposite to that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is generally known to apply developer compositions of the above type to electrostatic images by means of a magnetic applicator which comprises a cylindrical sleeve of non-magnetic material having a magnetic core positioned within. The core usually comprises a plurality of parallel magnetic strips which are arranged around the core surface to present alternating north and south oriented magnetic fields. These fields project radially, through the sleeve, and serve to attract the developer composition to the sleeve outer surface to form what is commonly referred to in the art as a "brushed nap". Either or both of the cylindrical sleeve and the magnetic core are rotated with respect to each other to cause the developer to advance from a supply sump to a position in which it contacts the electrostatic image to be developed. After development, the toner depleted carrier particles are returned to the sump for toner replenishment.

Conventionally, carrier particles made of soft magnetic materials have been employed to carry and deliver the toner particles to the electrostatic image. U.S. Pat. Nos. 4,546,060, 4,473,029 and 5,376,492, the teachings of which are incorporated herein by reference in their entirety, teach the use of hard magnetic materials as carrier particles and also apparatus for the development of electrostatic images utilizing such hard magnetic carrier particles. These patents require that the carrier particles comprise a hard magnetic material exhibiting a coercivity of at least 300 Oersteds when magnetically saturated and an induced magnetic moment of at least 20 EMU/gm when in an applied magnetic field of 1000 Oersteds. The terms "hard" and "soft" when referring to magnetic materials have the generally accepted meaning as indicated on page 18 of Introduction To Magnetic Materials by B. D. Cullity published by Addison-Wesley Publishing Company, 1972. These hard magnetic carrier materials represent a great advance over the use of soft magnetic carrier materials in that the speed of development is remarkably increased with good image development. Speeds as high as four times the maximum speed utilized in the use of soft magnetic carrier particles have been demonstrated.

In the methods taught by the foregoing patents, the developer is moved at essentially the same speed and direction as the electrostatic image to be developed by high speed rotation of the multi-pole magnetic core within the sleeve, with the developer being disposed on the outer surface of the sleeve. Rapid pole transitions on the sleeve are mechanically resisted by the carrier because of its high coercivity. The brushed nap of the carrier (with toner particles disposed on the surface of the carrier particles), rapidly "flip" on the sleeve in order to align themselves with the magnetic field reversals imposed by the rotating magnetic core, and as a result, move with the toner on the sleeve through the development zone in contact with or close relation to the electrostatic image on a photoconductor. See also, U.S. Pat. No. 4,531,832, the teachings of which are also incorporated herein in their entirety, for further discussion concerning such a process.

The rapid pole transitions, for example as many as 600 per second on the sleeve surface when the magnetic core is rotated at a speed of 2000 revolutions per minute (rpm), create a highly energetic and vigorous movement of developer as it moves through the development zone. This vigorous action constantly recirculates the toner to the sleeve surface and then back to the outside of the nap to provide toner for development. This flipping action also results in a continuous feed of fresh toner particles to the image. As described in the above-described patents, this method provides high density, high quality images at relatively high development speeds.

The above-mentioned U.S. patents, while generic to all hard magnetic materials having the properties set forth therein, prefer the hard magnetic ferrites which are compounds of barium and/or strontium, such as, $BaFe_{12}O_{19}$, $SrFe_{12}O_{19}$ and the magnetic ferrites having the formula $MO.6Fe_2O_3$, where M is barium, strontium or lead as disclosed in U.S. Pat. No. 3,716,630. While these bard ferrite carrier materials represent a substantial increase in the speed with which development can be conducted in an electrostatographic apparatus, many users of such equipment seek even faster development speeds and so further improvements to the carrier and development process are of interest.

U.S. Pat. No. 4,764,445 discloses hard magnetic ferrite carrier particles for electrographic developing applications which contain from about 1 to about 5 percent by weight of lanthanum. As mentioned in this patent, the speed of development in an electrographic process using conventional hard magnetic ferrite materials, while higher than methods using other techniques, such as with soft magnetic carriers, is limited by the resistivity of such ferrite materials. The patent discloses that addition of lanthanum to the hard magnetic ferrite crystal structure in the disclosed amounts results in a more conductive magnetic ferrite particle, yielding greater development efficiency and/or speed of development.

Others have also proposed methods for making conductive carrier particles. For example, U.S. Pat. No. 4,855,206 discloses adding neodymium, praseodymium, samarium, europium, or mixtures thereof, or a mixture of one or more of such elements and lanthanum, to a hard magnetic ferrite material to increase conductivity. U.S. Pat. No. 5,795,692 discloses a conductive carrier composition having a magnetic oxide core which is said to be coated with a layer of zinc metal that is the reaction product of zinc vapor and the magnetic oxide.

Other carriers proposed for use in an electrographic process include multi-phase ferrite composites as taught in U.S. Pat. Nos. 4,855,205; 5,061,586; 5,104,761; 5,106,714; 5,190,841; and 5,190,842.

U.S. Pat. No. 5,268,249 discloses magnetic carrier particles with a single-phase, W-type hexagonal crystal structure of the formula $MFe_{16}Me_2O_{27}$ where M is strontium or barium and Me is a divalent transition metal selected from nickel, cobalt, copper, zinc, manganese, magnesium, or iron.

While some of the above-described carriers may have increased conductivity relative to traditional hard magnetic materials previously employed in development of electrostatic images, in many instances the conductivity of the carrier is so great that imaging problems are created due to the carrier being deposited in the image. Although not clear, it is believed that certain levels of conductivity in the carrier can facilitate a flow of charge between the carrier on the nap and the shell, thereby inducing a charge reversal on the carrier and allowing the carrier particles to electrostatically deposit in the image, referred to hereinafter as "image carrier pickup" or "I-CPU". The presence of I-CPU can impact color rendition and image quality.

As can be seen, it would be desirable to develop new carriers that can be used in an electrographic process for the development of latent electrostatic images. It would also be desirable to develop carriers that can exhibit an greater level of conductivity relative to traditional magnetic materials previously employed in such processes, which would provide not only higher development efficiency, but also preferably reduced levels of I-CPU.

SUMMARY OF THE INVENTION

The foregoing objects and advantages are realized by the present invention, which, in one aspect, concerns carrier particles for use in the development of electrostatic latent images that comprise a hard magnetic material having a single-phase hexagonal crystal structure. The hard magnetic material is doped with at least one metal that, upon substitution of said metal into said crystal structure, produces a multi-valent ion of the formula $M^{n+}$, wherein n is an integer of at least 4.

In another aspect, the invention is directed to carrier particles for use in the development of electrostatic latent images which comprise a hard magnetic ferrite material having a single phase hexagonal crystal structure and represented by the formula:

$$PFe_{12-x}M_xO_{19}$$

wherein:

P is selected from strontium, barium, or lead;

M is at least one metal selected from antimony, arsenic, germanium, hafnium, molybdenum, niobium, silicon, tantalum, tellurium, tin, titanium, tungsten, vanadium, zirconium, or mixtures thereof; and x is less than about 0.6.

The invention in another aspect contemplates a two-component electrographic developer suitable for high speed copying applications without loss of copy image quality, which developer comprises charged toner particles and oppositely charged carrier particles as described hereinabove above.

The invention further contemplates a one-component developer comprising the hard magnetic materials described hereinabove.

In another aspect, the invention also concerns methods of developing electrostatic images on a photoconductive surface by utilizing the foregoing two-component or single-component developers.

DETAILED DESCRIPTION OF THE INVENTION

As previously pointed out in connection with U.S. Pat. Nos. 4,546,060 and 4,473,029, the disclosures of which have been incorporated herein by reference, the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO.6Fe_2O_3$ wherein M is barium, strontium or lead. These materials have a single-phase hexagonal structure. While the speed with which development can be carried out is much higher than prior techniques, they are limited by the resistivity of the above described ferrite materials which have the necessary magnetic properties for carrying out the development method. It is generally known that the resistivity of the carrier particles bears a direct result on the speed of development that can be employed.

While development speed is generally referred to in the prior art, a more meaningful term is to speak of "development efficiency". In a magnetic brush development system, development efficiency is defined as the potential difference between the photoreceptor in developed image areas before and after development divided by the potential difference between the photoreceptor and the brush prior to development times 100. For example, in a charged area development system, if the photoreceptor film voltage is −250 volts and the magnetic brush is −50 volts, the potential difference is −200 volts prior to development. If, during development, the film voltage is reduced by 100 volts to −150 volts in image areas by the deposition of positively charged toner particles, the development efficiency is (−100 volts divided by −200 volts) times 100, which gives an efficiency of development of 50 percent. It can be readily seen that as the efficiency of the developer material increases the various parameters employed in the electrostatographic method can be altered in accordance therewith. For example, as the efficiency increases the voltage differential prior to development can be reduced in order to deposit the same amount of toner in image areas as was previously done at the lower efficiency. The same is true with regard to the exposure energy level employed to impart the latent electrostatic image on the photoreceptor film. The speed of the development step of the procedure can be increased as the efficiency increases in that as the efficiency increases more toner can be deposited under the same conditions in a shorter period of time. Thus, higher development efficiency permits the reoptimization of the various parameters employed in the electrostatic process thereby resulting in savings in both energy and time.

The efficiency of development when employing ferrite carriers is limited by the resistivity of the ferrite materials themselves. For example, because these materials have a resistivity of approximately $1\times10^{11}$ ohm-cm, therefore, the highest efficiency is approximately 50 percent. However, in order to obtain high quality copies of the original image, it is necessary to maintain high magnetic properties; i.e. a coercivity of at least about 300 Oersteds when magnetically saturated and an induced magnetic moment of at least about 20 EMU/gm when in an applied field of 1000 Oersteds while at the same time increasing the conductivity of the particles. In addition, to obtain high quality copies with minimum amounts of I-CPU, it is preferable to maintain the resistivity of the ferrite carrier to a value of from about $1\times10^9$ ohm-cm to about $1\times10^5$ ohm-cm, and more preferably from about $1\times10^9$ ohm-cm to about $1\times10^7$ ohm-cm.

The present invention contemplates substitution of an effective amount of at least one multi-valent metal ion into the crystalline lattice of a hard magnetic ferrite material having a hexagonal crystal structure, the metal ion corresponding to the formula $M^{n+}$, where n is an integer of at least 4, i.e, 4, 5, or 6, so as to reduce the resistivity of the material while still maintaining desirable magnetic properties. Thus, the resistivity of hard hexagonal ferrite materials can be reduced from approximately $1\times10^{11}$ to approximately $1\times10^5$ ohm-cm, and preferably the resistivity is reduced to within the ranges specified in the preceding paragraph for inhibiting I-CPU, without effecting the high magnetic properties of the ferrite material.

While not wishing to be bound by theory, it is believed, from size and charge considerations of the cations to be substituted, that the mechanism by which the resistivity of the ferrite materials are decreased is due to substitution of the above-described multi-valent metal ion into the iron lattices of the hexagonal ferrite crystal structure, rather than by replacement of $Sr^{2+}Ba^{2+}$, or $Pb^{2+}$in the sub-lattice or interstitially in the hexagonal ferrite lattice. In doing so, the $M^{n+}$ multi-valent metal ion substituents force a charge compensation in the ferric ($Fe^{3+}$) lattice; i.e., ferrous ($Fe^{2+}$) cations form. The $Fe^{2+}/Fe^{3+}$ charge couple thereby created provides a semi-conductive electronic pathway, resulting in ferrite compositions of higher conductivity.

In a preferred embodiment, a hard magnetic ferrite material doped with the $M^{n+}$ multi- valent metal ion can be represented by the formula:

$$PFe_{12-x}M_xO_{19}$$

wherein:

P is selected from strontium, barium, or lead;

M is selected from at least one of antimony, arsenic, germanium, hafnium, molybdenum, niobium, silicon, tantalum, tellurium, fin, titanium, tungsten, vanadium, zirconium, or mixtures thereof; and x is less than about 0.6.

In especially preferred embodiments, P is selected from either strontium or barium, and more preferably strontium due to cost, magnetic properties, and environmental concerns. M is preferably selected from silicon, zirconium, tin, or titanium due largely to cost and availability concerns. The amount of the multi-valent metal ion employed is preferably sufficient to yield a value for x of less than about 0.3, and more preferably less than about 0.2 due to I-CPU concerns. If the multi-valent metal ion is employed in an amount greater than 0.6, the conductivity does not significantly increase relative to ferrites containing a lesser amount of the multi-valent metal ion. A further advantage associated with the hard magnetic ferrites of the present invention is that by conducting a relatively light doping of the multi-valent metal ion into the ferrite material, one can see significant improvement in development efficiency, as is exemplified by Examples 3740 hereinbelow, as well as in copending U.S. patent application Ser. No. 60/204,941 (Attorney Docket No. 10034-3P) filed on even date herewith and previously incorporated herein by reference. Also, with respect to preparation of such hard magnetic materials, it is believed that substitution of such metal ions into the iron lattice offers processing advantages relative to a substitution into the $Sr^{2+}$ $Ba^{2+}$, or $Pb^{2+}$ sub-lattice.

With respect to the amount of the $M^{n+}$ multi-valent metal ion substituted into the hard magnetic material, the amount substituted should be sufficient to increase the conductivity at least about one order of magnitude, i.e., a reduction in resistivity of at least about $1\times10^1$ ohm-cm. Preferably, in terms of the x value as mentioned above, the amount of metal substituted should be sufficient to give an x value of from about 0.01 to about 0.6, and preferably an amount sufficient to yield an x value of from about 0.02 to less than about 0.3, and more preferably an amount sufficient to yield an x value of from about 0.03 to less than about 0.2 is employed. It is preferred that the amount of the $M^{n+}$ multi-valent metal ion substituted into the crystalline lattice be limited such that the resulting structure comprises substantially a single-phase hexagonal crystalline structure. While the amount of $M^{n+}$ multi-valent metal ion employed can vary somewhat depending upon the $M^{n+}$ multi-valent metal ion and sintering conditions utilized in the preparation of the ferrite particles, the amount of the $M^{n+}$ multi-valent metal ion can generally be added in an amount of up to about 10 percent by weight of the ferrite material and still maintain sufficiently high magnetic properties to tightly adhere the developer nap to the sleeve of the developer station. As the quantity of the $M^{n+}$ multi-valent metal ion added exceeds the foregoing range, additional phases in the $PO/MO_{n/2}/Fe_2O_3$ phase diagram can form. The presence of a minor amount, i.e., preferably less than 50 wt % based on total weight of carrier, of such additional phases does not adversely impact the beneficial properties of a substituted hexagonal crystal structure as previously described.

The preparation of hard magnetic materials generally, and hard, hexagonal crystal structure ferrites (Ba, Sr or Pb) in particular, are well documented in the literature. Any suitable method of making the hard magnetic particles may be employed, such as the methods disclosed in U.S. Pat. Nos. 3,716,630, 4,623,603 and 4,042,518, the teachings of which are incorporated herein by reference in their entirety; European Patent Application No. 0 086 445; "Spray Drying" by K. Masters published by Leonard Hill Books London, pages 502–509 and "Ferromagnetic Materials", Volume 3 edited by E. P. Wohifarth and published by North-Holland Publishing Company, Amsterdam, New York, Oxford, pages 315 et seq, the teachings of which are also incorporated herein by reference.

Hard magnetic materials containing at least one multi-valent metal ion substituted into the crystalline lattice as described hereinabove can be prepared in a similar manner as described in the preceding paragraph by adding a source of the multi-valent metal ion to the formulation so that the metal ion is doped into the crystalline structure. For example, if the hard magnetic material to be prepared is a hard magnetic strontium ferrite containing from about 1 to about 5 percent by weight of the multi-valent metal in its oxide or an oxide precursor form, then from about 8 to 12 parts $SrCO_3$, about 1 to 5 parts of a source of the metal ion and 85 to 90 parts of $Fe_2O_3$ are mixed with a dispersant polymer, gum arabic, and water as a solvent to form a slurry. The solvent is removed by spray drying the slurry and the resultant green beads are fired at from about 100° C. to about 1300° C. in an oxidizing environment to form the desired hard magnetic material described above. The hard magnetic material is then deagglomerated to yield the component carrier bead particles with a particle size generally required of carrier particles, that is, less than about 100 $\mu$m and preferably from about 3 to 65 $\mu$m, and the resulting carrier particles are then permanently magnetized by subjecting them to an applied magnetic field of sufficient strength to induce a permanent magnetic hysteresis behavior.

The present invention comprises two types of carrier particles. The first of these carriers comprises a binder-free, magnetic particulate hard magnetic material, doped with at least one multi-valent metal ion, and exhibiting the requisite coercivity and induced magnetic moment as previously described. This type of carrier is preferred.

The second is heterogeneous and comprises a composite of a binder (also referred to as a matrix) and a magnetic material exhibiting the requisite coercivity and induced magnetic moment. The hard magnetic material as previously described herein is dispersed as discrete smaller particles throughout the binder. However, binders employed as known to those in the art can be highly resistive in nature, such as in the case of a polymeric binder, such as vinyl resins like polystyrene, polyester resins, nylon resins, and polyolefin resins as described in U.S. Pat. No. 5,256,513. As such, any reduction in conductivity of the magnetic material may be offset by the resistivity of the binder selected. It should be appreciated that the resistivity of these composite carriers must be comparable to the binder-less carrier in order for advantages concerning development efficiency as previously described to be realized. It may be desirable to add conductive carbon black to the binder to facilitate electrical conductance between the ferrite particles.

The individual bits of the magnetic material should preferably be of a relatively uniform size and sufficiently smaller in diameter than the composite carrier particle to be produced. Typically, the average diameter of the magnetic material should be no more than about 20 percent of the average diameter of the carrier particle. Advantageously, a much lower ratio of average diameter of magnetic component to carrier can be used. Excellent results are obtained with magnetic powders of the order of 5 $\mu$m down to 0.05 $\mu$m average diameter. Even finer powders can be used when the degree of subdivision does not produce unwanted modifications in the magnetic properties and the amount and character of the selected binder produce satisfactory strength, together with other desirable mechanical and electrical properties in the resulting carrier particle.

The concentration of the magnetic material in the composite can vary widely. Proportions of finely divided magnetic material, from about 20 percent by weight to about 90 percent by weight, of composite carrier can be used as long as the resistivity of the particles is that representative of the hard magnetic particles as described above.

The induced moment of composite carriers in a 1000 Oersteds applied field is dependent on the concentration of magnetic material in the particle. It will be appreciated, therefore, that the induced moment of the magnetic material should be sufficiently greater than about 20 EMU/gm to compensate for the effect upon such induced moment from dilution of the magnetic material in the binder. For example, one might find that, for a concentration of about 50 weight percent magnetic material in the composite particles, the 1000 Oersteds induced magnetic moment of the magnetic material should be at least about 40 EMU/gm to achieve the minimum level of 20 EMU/gm for the composite particles.

The binder material used with the finely divided magnetic material is selected to provide the required mechanical and electrical properties. It should (1) adhere well to the magnetic material, (2) facilitate formation of strong, smooth-surfaced particles and (3) preferably possess sufficient difference in triboelectric properties from the toner particles with which it will be used to insure the proper polarity and magnitude of electrostatic charge between the toner and carrier when the two are mixed.

The matrix can be organic, or inorganic, such as a matrix composed of glass, metal, silicone resin or the like. Preferably, an organic material is used such as a natural or synthetic polymeric resin or a mixture of such resins having appropriate mechanical properties. Appropriate monomers (which can be used to prepare resins for this use) include, for example, vinyl monomers such as alkyl acrylates and methacrylates, styrene and substituted styrenes, and basic monomers such as vinyl pyridines. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of composite carrier particles according to this invention may involve the application of heat to soften thermoplastic material or to harden thermosetting material; evaporative drying to remove liquid vehicle; the use of pressure, or of heat and pressure, in molding, casting, extruding, or the like and in cutting or shearing to shape the carrier particles; grinding, e.g., in a ball mill to reduce carrier material to appropriate particle size; and sifting operations to classify the particles.

According to one preparation technique, the powdered magnetic material is dispersed in a solution of the binder resin. The solvent may then be evaporated and the resulting solid mass subdivided by grinding and screening to produce carrier particles of appropriate size. According to another technique, emulsion or suspension polymerization is used to produce uniform carrier particles of excellent smoothness and useful life.

The coercivity of a magnetic material refers to the minimum external magnetic force necessary to reduce the induced magnetic moment from the remanance value to zero while it is held stationary in the external field, and after the material has been magnetically saturated, i.e., the material has been permanently magnetized. A variety of apparatus and methods for the measurement of coercivity of the present carrier particles can be employed. For the present invention, a Lakeshore Model 7300 Vibrating Sample Magnetometer, available from Lakeshore Cryotronics of Westerville, Ohio, is used to measure the coercivity of powder particle samples. The magnetic ferrite powder is mixed with a nonmagnetic polymer powder (90 percent magnetic powder; 10 percent polymer by weight). The mixture is placed in a capillary tube, heated above the melting point of the polymer, and then allowed to cool to room temperature. The filled capillary tube is then placed in the sample holder of the magnetometer and a magnetic hysteresis loop of external field (in Oersteds) versus induced magnetism (in EMU/gm) is plotted. During this measurement, the sample is exposed to an external field of 0 to ±8000 Oersteds.

The carrier particles may be coated to properly charge the toner particles of the developer. This can be done by forming a dry mixture of the hard magnetic material with a small amount of powdered resin, e.g., from about 0.05 to about 3.0 weight percent resin based on total weight of the material and resin, and then heating the mixture to fuse the resin. Such a low concentration of resin will form a thin or discontinuous layer of resin on the magnetic particles.

Since the presence of the multi-valent metal ion in the hard magnetic material is intended to improve conductivity of carrier particles, the layer of resin on the carrier particles should be thin enough that the mass of particles remains suitably conductive. Preferably the resin layer is discontinuous for this reason; spots of bare hard magnetic material on each particle provide conductive contact.

Various resin materials can be employed as a coating on the hard magnetic carrier particles. Examples include those described in U.S. Pat. Nos. 3,795,617; 3,795,618, and 4,076,857, the teachings of which are incorporated herein by reference in their entirety. The choice of resin will depend upon its triboelectdric relationship with the intended toner. For use with toners which are desired to be positively charged, preferred resins for the carrier coating include fluorocarbon polymers such as poly(tetrafluoroethylene), poly(vinylidene fluoride) and poly(vinylidene fluoride-co-tetrafluoroethylene) For use with toners which are desired to be negatively charged, preferred resins for the carrier include silicone resins, as well as mixtures of resins, such as a mixture of poly(vinylidene fluoride) and polymethylmethacrylate. Various polymers suitable for such coatings are also described in U.S. Pat. No. 5,512,403, the teachings of which are incorporated herein by reference in their entirety.

The developer is formed by mixing the carrier particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 weight percent carrier and from about 25 to 1 weight percent toner.

The toner component of the invention can be a powdered resin which is optionally colored. It normally is prepared by compounding a resin with a colorant, i.e., a dye or pigment, either in the form of a pigment flush (a special mixture of pigment press cake and resin well-known to the art) or pigment-resin masterbatch, as well as any other desired addenda known to art. If a developed image of low opacity is desired, no colorant need be added. Normally, however, a colorant is included and it can, in principle, be any of the materials mentioned in Colour Index, Vols. I and II, 2nd Edition. Carbon black is especially useful. The amount of colorant can vary over a wide range, e.g., from about 3 to about 20 weight percent of the toner component. Combinations of colorants may be used as well.

The mixture of resin and colorant is heated and milled to disperse the colorant and other addenda in the resin. The mass is cooled, crushed into lumps and finely ground. The resulting toner particles can range in diameter from about 0.5 to about 25 $\mu$m with an average size of from about 1 to about 16 $\mu$m. Preferably, the average particle size ratio of carrier to toner particles lies within the range from about 15:1 to about 1:1. However, carrier-to-toner average particle size ratios of as high as 50:1 are useful.

The toner resin can be selected from a wide variety of materials, including both natural and synthetic resins and modified natural resins, as disclosed, for example, in U.S. Pat. No. 4,076,857. Especially useful are the crosslinked polymers disclosed in U.S. Pat. Nos. 3,938,992 and 3,941,898. The crosslinked or noncrosslinked copolymers of styrene or lower alkyl styrenes with acrylic monomers such as alkyl acrylates or methacrylates are particularly useful. Also useful are condensation polymers such as polyesters. Numerous polymers suitable for use as toner resins are disclosed in U.S. Pat. No. 4,833,060. The teachings of U.S. Pat. Nos. 3,938,992, 3,941,898, 4,076,857; and 4,833,060 are incorporated by reference herein in their entirety.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sep. 5, 1979, to J. Ugelstad, as well as by suspension polymerization, such as the method disclosed in U.S. Pat. No. 4,833,060, previously incorporated by reference.

The toner can also contain minor amounts of additional components as known to the art, such as charge control agents and antiblocking agents. Especially useful charge control agents are disclosed in U.S. Pat. No. 3,893,935 and 4,206,064, and British Pat. No. 1,501,065, the teachings of which are incorporated herein by reference in their entirety. Quaternary ammonium salt charge agents as disclosed in Research Disclosure, No. 21030, Volume 210, October, 1981 (published by Industrial Opportunities Ltd., Homewell, Havant, Hampshire, P09 1EF, United Kingdom) are also useful.

In an embodiment of the method of the present invention, an electrostatic image is brought into contact with a magnetic brush development station comprising a rotating-magnetic core, an outer non-magnetic shell, and either the one-component or two-component, dry developers as described hereinabove. The electrostatic image so developed can be formed by a number of methods such as by imagewise photodecay of a photoreceptor, or imagewise application of a charge pattern on the surface of a dielectric recording element. When photoreceptors are employed, such as in high-speed electrophotographic copy devices, the use of halftone screening to modify an electrostatic image can be employed, the combination of screening with development in accordance with the method for the present invention producing high-quality images exhibiting high Dmax and excellent tonal range. Representative screening methods including those employing photoreceptors with integral half-tone screens are disclosed in U.S. Pat. No. 4,385,823.

Developers comprising magnetic carrier particles in accordance with the present invention when employed in an apparatus such as that described in U.S. Pat. No. 4,473,029 can exhibit a dramatic increase in development efficiency when compared with traditional magnetic ferrite materials as employed in U.S. Pat. No. 4,473,029 when operated at the same voltage differential of the magnetic brush and photoconductive film. For example, when the performance of traditional strontium ferrite carrier particles, similar in all respects except for the presence of the above-described multi-valent metal ion, are compared with the carrier particles of the present invention, the development efficiency can be improved at least from about 50 percent, and preferably up to 100 percent and even 200 percent, all other conditions of development remaining the same. Thus, by employing the carrier particles in accordance with this invention, the operating conditions such as the voltage differential, the exposure energy employed in forming the latent electrostatic image, and the speed of development, may all be varied in order to achieve optimum conditions and results.

The invention is further illustrated by the following examples:

Specific Embodiments of the Invention

In the following examples, all parts and percentages are by weight and temperatures are in degrees Celsius (°C), unless otherwise indicated.

EXAMPLES 1–4

Preparation of Strontium Ferrite Carrier Doped with $Ti^{4+}$

An undoped precursor mixture for a strontium ferrite magnetic carrier is initially prepared by the following procedure. A slurry of $Fe_2O_3$ and $SrCO_3$ (at a molar ratio of 5.7:1) is prepared by adding 301.17 grams (g) of $Fe_2O_3$ powder (α-phase - KFH-NA grade - available from Toda Koygo of Japan); 48.83 g $SrCO_3$ powder (Type D available from Chemical Products Corporation of Cartersville, Ga.); and 350 g of an aqueous binder solution to a 1250 milliliter (ml) glass bottle. The binder solution is prepared by adding measured amounts of gum arabic (acacia powder available from Eastman Kodak Company of Rochester, N.Y.) and ammonium polymethacrylate (DAXAD 32 available from W.R. Grace of Lexington, Mass.) sufficient to provide a solution containing 3.94 wt % gum arabic and 0.33 wt % ammonium polymethacrylate respectively. The pH of the resulting slurry is thereafter adjusted with concentrated $NH_4OH$ to a value of about 8–9.

For Examples 1–4, the above-described strontium ferrite precursor mixture is doped with $Ti^{4+}$ using $TiO_2$ powder (Degussa P25 - Lot PIS-13A7) as a source, without intentional substitution of the $Ti^{4+}$ ion into either the iron or strontium stoichiometries of the crystalline lattice. For each example, a measured amount of the $TiO_2$ powder as shown in Table I is added as a dry powder to 100 parts of the strontium ferrite precursor mixture and the two are mixed. Table I also gives a value for x in the formula: $SrFe_{12-x}Ti_xO_{19}$.

To the slurry is added 300 ml of 1 millimeter (mm) zirconium silicate media beads and the resulting mixture is rolled in a roll mill for at least 24 hours. The resulting mill is pumped to a rotary atomizer operating at a speed of at least 16,000 revolutions per minute (rpm) on a laboratory spray dryer, a portable model available from Niro Atomizer of Copenhagen, Denmark. The spray dryer produces a dried product ("green bead") which is collected with a cyclone.

Firing of the green bead is conducted by placing the green beads in alumina trays and charging them into a high temperature box furnace. The temperature of the furnace is ramped at a rate of 7° C./min to a temperature 500° C., at which point the temperature is maintained at 500° C. for 1 hour to burnout the binder portion of the green bead. Subsequently, the furnace temperature is ramped at a rate of 5° C./min to the final firing temperature. The furnace is held at the firing temperature of 1250° C. for 10 hours, whereupon the furnace is allowed to cool without control (i.e., "free-fall") to room temperature. The fired charges are deagglomerated with a mortar and pestle and screened through a 200 mesh screen to obtain strontium ferrite carrier particles doped with $Ti^{4+}$ multi-valent metal ions.

The resistivities measured for each resulting carrier are shown in Table I below. Static resistivity is measured using a cylindrically-shaped electrical cell. The cell employed has a cylindrical chamber therein which is concentric with the centerline of the cell. The cell is in two parts, an upper section with an electrode piston located concentrically therein and aligned along the centerline of the cylinder, and a bottom section with an electrode base. The upper section connects to the bottom section, thereby forming the cell's overall cylindrical shape. The circular bottom surface of the piston within the upper section and the circular base of the bottom section define the ends of the cylindrical chamber within the cell. The piston can be actuated and extended downwardly along the centerline of the cell by a small lever that extends radially outward from the cylinder. The base of the bottom section of the cell has a small, centered electrode therein. The piston in the upper section is itself an electrode and thereby forms the opposing electrode. To use the cell, approximately 200 g of carrier to be tested is placed on the circular metal base in contact with the electrode. The top portion of the cell is placed on the bottom electrode base and aligned. The release lever is lowered and the piston electrode from the upper section is lowered onto the powder. The depth of the powder is adjusted by physical rotation of the top portion of the cell to give a spacing of 0.04 inches. The average resistivity (in ohm-cm) is determined by measurement of the electrical current flow through the cell using a Keithley Model 616 current meter (obtained from Keithley Corporation of Cleveland, Ohio) for three applied voltages in a range of 10–250 V. Resistivity is determined using Ohm's law.

For each example, the resulting doped carrier is used to prepare a two-component developer using a yellow polyester toner prepared substantially as described in U.S. Pat. No. 4,833,060, the teachings of which are incorporated herein in their entirety. The developer is produced by mixing together each carrier with the above-described toner using a toner concentration (TC) of about 6 wt % (the actual measured value for TC is shown in Table I). For each example, the charge-o-mass ratio (q/m) is measured and the value obtained is also shown in Table I.

To measure the toner q/m ratio, the toner and carrier particles are first combined to form a developer mixture. Toner charge (q/m) is measured in microcoulombs per gram (μC/g) within a "MECCA" device described hereinafter, after being subjected to the "exercise periods", also as described hereinafter.

The first exercise period consists of vigorously shaking the developer to cause triboelectric charging by placing a 4–7 g portion of the developer into a 4 dram glass screw cap vial, capping the vial and shaking the vial on a "wrist-action" robot shaker operated at about 2 Hertz (Hz) and an overall amplitude of about 11 centimeters (cm) for 2 minutes. The charge, if obtained at this point, is commonly referred to as the "fresh" charge.

The charge level cited in Examples 1–4 is obtained by subjecting the toner to an additional, second exercise period of 10 minutes on top of a rotating-core magnetic brush. The vial as taken from the robot shaker is constrained to the brush while the magnetic core is rotated at 2000 rpm to approximate actual use of the developer in an electrographic process. Thus, the developer is exercised as if it were directly on a magnetic brush, but without any loss of developer, because it is contained within the vial. Toner charge level after this exercise is designated as "10 min BB" in the tables hereinafter.

The toner q/m ratio is measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner q/m ratio in terms of microcoulombs per gram (μC/g) is calculated by dividing the accumulated charge by the mass of the deposited toner taken from the upper plate.

TABLE I

| Example No. | x | $TiO_2$ level pph | resistivity ohm-cm | 10 min q/m $\mu$C/g | TC wt % |
|---|---|---|---|---|---|
| | | $TiO_2$ addenda @1250° C. | | | |
| 1 | 0.035 | 0.25 | $3.1 \times 10^8$ | −51.0 | 6.1 |
| 2 | 0.069 | 0.5 | $4.3 \times 10^7$ | −48.3 | 6.0 |
| 3 | 0.138 | 1.0 | $8.2 \times 10^6$ | −51.7 | 6.0 |
| 4 | 0.272 | 2.0 | $1.7 \times 10^7$ | −21.2 | 6.0 |

As can be seen from Table I, static resistivity drops about two orders of magnitude over Examples 1–4. The toner q/m values also show a decrease with $TiO_2$ level.

Comparative Example A

In Comparative Example A, the static resistivity and triboelectric properties of a commercially-prepared $SrFe_{12}O_{19}$ hard ferrite carrier are measured according to the analytical procedures described in Examples 1–4 and compared to the results obtained in Examples 1–4. The commercially available carrier is a $SrFe_{12}O_{19}$ hard ferrite available from POWDERTECH of Valparaiso, Ind. This carrier is used to make a developer with the same toner described in Examples 1–4. The resistivity measured for the carrier is $2.0\times10^{10}$ ohm-cm, the toner q/m is—71.1 $\mu$C/g, and the TC is 6.3 wt %. The data shows properties for a conventional hard ferrite material.

Comparative Example B

In Comparative Example B, the static resistivity and triboelectric properties of a commercially-prepared $SrFe_{12}O_{19}$ hard ferrite carrier doped with lanthanum are measured according to the analytical procedures described in Examples 1–4 and compared to the results obtained in Examples 1–4. The carrier contains about 2.8 wt % lanthanum and is prepared substantially according to U.S. Pat. No. 4,764,445, the teachings of which have been previously incorporated herein by reference. This carrier is used to make a developer with the same toner as described in Examples 1–4. The resistivity measured for the carrier is $5.0\times10^6$ohm-cm, the toner q/m (10 min BB) is −70.5 $\mu$C/g, and the TC is 6.4 wt %. The results in comparison with Comparative Example A shows the range of resistivity between a conventional strontium ferrite carrier and a conventional lanthanum-containing, strontium ferrite carrier.

EXAMPLES 5–8

Preparation of Strontium Ferrite Magnetic Carrier Doped With $Ge^{4+}$

For Examples 5–8, the procedure of Examples 1–4 is substantially repeated, except as provided hereinafter. The strontium ferrite precursor mixture prepared as described in Examples 1–4 is doped with $Ge^{4+}$ using germanium dioxide powder (obtainable from Eagle Picher Industries of Quapau, Okla.) as a source. For each example, a measured amount of the powder as shown in Table II is added as a dry powder to 100 parts of the precursor mixture prepared from Examples 1–4 and the two components are mixed. After milling and spray drying as in Examples 1–4, the resulting mixture is placed in alumina trays and calcined in a high temperature box furnace at a temperature 1250° C. and maintained at that temperature for 10 hours, whereupon the furnace is allowed to cool to provide a $Ge^{4+}$ doped strontium ferrite carrier. The resistivities measured for each resulting carrier are shown in Table II below. Table II also gives a value for x in the formula: $SrFe_{12-x}Ge_xO_{19}$.

For each example, the resulting doped carrier is used to prepare a two-component developer as in Examples 1–4. For each example, the charge-to-mass ratio (q/m) is measured and the values obtained are also shown in Table II.

TABLE II

| Example No. | x | $GeO_2$ level pph | resistivity ohm-cm | 10 min q/m $\mu$C/g | TC wt % |
|---|---|---|---|---|---|
| | | $Ge^{4+}$ addenda @1250° C. | | | |
| 5 | 0.027 | 0.25 | $2.0 \times 10^8$ | −49.6 | 6.6 |
| 6 | 0.053 | 0.5 | $1.1 \times 10^8$ | −55.2 | 6.6 |
| 7 | 0.106 | 1.0 | $9.5 \times 10^6$ | −58.9 | 6.3 |
| 8 | 0.158 | 1.5 | $3.4 \times 10^6$ | −38.5 | 6.0 |

As can be seen from Table II, static resistivity drops about two orders of magnitude over the range of $GeO_2$ added in Examples 5–8.

EXAMPLES 9–12

Preparation of Strontium Ferrite Magnetic Carriers Doped With $Zr^{4+}$

For Examples 9–12 the procedure of Examples 1–4 is substantially repeated, except as specified hereinafter. The strontium ferrite precursor mixture prepared as described in Examples 1–4 is doped with $Zr^{4+}$ using fumed $ZrO_2$ as a source. The $ZrO_2$ is obtained from Degussa of Germany. For each example, a measured amount of the fumed $ZrO_2$ powder as shown in Table III is added as a dry powder to 100 parts of the precursor mixture and the two are mixed. After milling and spray drying as in Examples 1–4, the resulting mixture is placed in alumina trays and calcined at a temperature 1250° C. for 10 hours, whereupon the furnace is allowed to cool to provide a $Zr^{4+}$ doped carrier. The resistivities measured for each resulting carrier are shown in Table III below. Table III also gives a value for x in the formula: $SrFe_{12-x}Zr_xO_{19}$.

For each example, the resulting doped carrier is used to prepare a two-component developer as in Examples 1–4. For each example, the charge-o-mass ratio (q/m) is measured and the values obtained are also shown in Table III.

TABLE III

| Example No. | x | $ZrO_2$ level pph | resistivity ohm-cm | 10 min q/m $\mu$C/g | TC wt % |
|---|---|---|---|---|---|
| | | $Zr^{4+}$ addenda @1250° C. | | | |
| 9 | 0.023 | 0.25 | $2.6 \times 10^9$ | −70.6 | 6.4 |
| 10 | 0.045 | 0.5 | $5.9 \times 10^8$ | −67.0 | 6.3 |
| 11 | 0.090 | 1.0 | $9.4 \times 10^6$ | −70.9 | 6.4 |
| 12 | 0.178 | 2.0 | $3.8 \times 10^6$ | −82.0 | 6.0 |

As can be seen from Table III, static resistivity drops about three orders of magnitude over the range of Examples 9–12.

EXAMPLES 13–20

Preparation of Strontium Ferrite Magnetic Carriers Doped With $Sn^{4+}$

For Examples 13–20 the procedure of Examples 1–4 is substantially repeated, except as specified hereinbelow. The strontium ferrite precursor mixture prepared as described in Examples 1–4 is doped with $Sn^{4+}$ using $SnC_2O_4$ powder obtained from AESAR (Johnson Matthey, Inc.) of Seabrook, N.H. as a source. For each example, a measured amount of the $SnC_2O_4$ powder sufficient to yield an amount of $SnO_2$ as shown in Tables IV and V is added as a dry powder to 100 parts of the precursor mixture and the two are mixed. After milling and spray drying, the resulting mixture is placed in alumina trays and calcined at a temperature of 1250° C. (Examples 13–16) and 1300° C. (Examples 17–20) for 10 hours, whereupon the furnace is allowed to cool to provide a $Sn^{4+}$) doped carrier. The resistivities measured for each resulting carrier are shown in Tables IV and V below. Tables IV and V also give a value for x in the formula: $SrFe_{12-x}Sn_xO_{19}$.

For Examples 13–16, the resulting doped carrier is used to prepare a two-component developer as in Examples 1–4. For Examples 13–16, the charge-to-mass ratio (q/m) is measured and the values obtained are also shown in Tables IV and V. A two-component developer is not evaluated for Examples 17–20.

TABLE IV

| $Sn^{4+}$ addenda @1250° C. | | | | | |
|---|---|---|---|---|---|
| Example No. | x | $SnO_2$ level pph | resistivity ohm-cm | 10 min q/m $\mu$C/g | TC wt % |
| 13 | 0.018 | 0.25 | $2.9 \times 10^9$ | −78.6 | 6.3 |
| 14 | 0.037 | 0.5 | $6.4 \times 10^7$ | −89.1 | 6.2 |
| 15 | 0.073 | 1.0 | $1.6 \times 10^6$ | −95.7 | 6.3 |
| 16 | 0.146 | 2.0 | $8.8 \times 10^5$ | −82.3 | 6.1 |

TABLE V

| $Sn^{4+}$ addenda @1300° C. | | | |
|---|---|---|---|
| Example No. | x | $SnO_2$ level pph | resistivity ohm-cm |
| 17 | 0.018 | 0.25 | $9.7 \times 10^8$ |
| 18 | 0.037 | 0.5 | $4.5 \times 10^8$ |
| 19 | 0.073 | 1.0 | $2.7 \times 10^6$ |
| 20 | 0.146 | 2.0 | $3.9 \times 10^5$ |

Comparison of the data in Tables IV and V shows that firing temperature does not appear to be a significant factor in determining resistivity of the carrier. This is consistent with a threshold temperature where the addenda cation is uniformly incorporated into the lattice.

EXAMPLES 21–32

Preparation of Strontium Ferrite Magnetic Carriers Doped With $Si^{4+}$

For Examples 21–32, the procedure of Examples 1–4 is substantially repeated, except as specified hereinafter. The strontium ferrite precursor mixture prepared as described in Examples 1–4 is doped with $Si^{4+}$ using an ammonium-stabilized, colloidal silica solution (Cabospherse A-2095 Grade, 17 wt % $SiO_2$ obtained from Cabot Corporation of Tuscola, Ill.) as a source. For each example, a measured amount of the silica solution sufficient to provide an $SiO_2$ loading as shown in Table VI is added to 100 parts of the strontium ferrite precursor mixture and mixed. After milling and spray drying as in Examples 1–4, the resulting mixture is placed in alumina trays and calcined in a high temperature box furnace at a temperature of from 1150 to 1300° C. as shown in Table VI and maintained at such temperature for 10 hours, whereupon the furnace is allowed to cool to provide a $Si^{4+}$ doped carrier. The resistivities measured for each resulting carrier are shown in Table VI below. Table VI also gives a value for x in the formula: $SrFe_{12-x}Si_xO_{19}$.

For each example, the resulting doped carrier is used to prepare a two-component developer as in Examples 1–4, except that the blend is adjusted to provide a developer which is about 10 wt % toner (actual amount is listed in Table VI). For each example, the charge-to-mass ratio (q/m) is measured and the values obtained are also shown in Table VI.

TABLE VI

| $Si^{4+}$ Addenda @ Various Firing Temperatures and $Si^{4+}$ Loadings | | | | | | |
|---|---|---|---|---|---|---|
| Example No. | x | $SiO_2$ level pph | Firing Temp. ° C. | Resistivity ohm-cm | 10 min q/m $\mu$C/g | TC wt % |
| 21 | 0.031 | 0.18 | 1150 | $2.6 \times 10^9$ | −60.5 | 10.4 |
| 22 | 0.031 | 0.18 | 1200 | $9.1 \times 10^8$ | −73.5 | 10.2 |
| 23 | 0.031 | 0.18 | 1250 | $3.9 \times 10^8$ | −74.6 | 10.4 |
| 24 | 0.031 | 0.18 | 1300 | $7.2 \times 10^7$ | −80.5 | 10.2 |
| 25 | 0.053 | 0.30 | 1150 | $1.2 \times 10^9$ | −55.6 | 10.1 |
| 26 | 0.053 | 0.30 | 1200 | $7.7 \times 10^8$ | −58.6 | 10.5 |
| 27 | 0.053 | 0.30 | 1250 | $9.6 \times 10^8$ | −70.7 | 10.5 |
| 28 | 0.053 | 0.30 | 1300 | $3.3 \times 10^7$ | −77.9 | 10.3 |
| 29 | 0.071 | 0.40 | 1150 | $2.3 \times 10^9$ | −63.7 | 10.6 |
| 30 | 0.071 | 0.40 | 1200 | $3.4 \times 10^8$ | −72.1 | 10.0 |
| 31 | 0.071 | 0.40 | 1250 | $4.4 \times 10^8$ | −76.4 | 10.3 |
| 32 | 0.071 | 0.40 | 1300 | $3.9 \times 10^8$ | −76.1 | 10.2 |

As previously shown in Examples 13–20, the firing temperature does not appear to influence the resistivity of the resulting carrier. The 1150, 1200,and 1250° C. firings all display similar trends with silica level. The 1300° C. firings exhibit somewhat enhanced conductivities relative to the lower firing series. In comparison to some previous examples, the charge-to-mass values show a trend toward increasing values with addenda loading.

EXAMPLES 33–36

Preparation of Strontium Ferrite Magnetic Carriers Doped With $Ta^{5+}$

For Examples 33–36, the procedure of Examples 1–4 is substantially repeated except as provided hereinafter. The strontium ferrite precursor mixture prepared as described in Examples 1–4 (except the $Fe_2O_3$ powder is obtained from MEROX of Sweden) is doped with $Ta^{5+}$ using $Ta_2O_5$ powder (optical grade—obtainable from Cabot Corporation of Boyertown, Pa.) as a source. For each example, a measured amount of the $Ta_2O_5$ powder as shown in Table VII is added as a dry powder to 100 parts of the precursor mixture and the two are mixed. After milling and spray drying as in Examples 1–4, the resulting mixture is placed in alumina trays and calcined in a high temperature box furnace at a temperature 1250° C. for 10 hours, whereupon the furnace is allowed to cool to provide a $Ta^{5+}$ doped strontium ferrite carrier. The resistivities measured for each resulting carrier are shown in Table VII below. Table VII also gives a value for x in the formula: $SrFe_{12-x}Ta_xO_{19}$. The resulting carriers are not incorporated into a two-component developer as in Examples 1–4.

TABLE VII

| $Ta^{5+}$ addenda @1250° C. | | | |
|---|---|---|---|
| Example No. | x | $Ta_2O_5$ level pph | resistivity ohm-cm |
| 33 | 0.025 | 0.5 | $1.2 \times 10^9$ |
| 34 | 0.050 | 1.0 | $4.6 \times 10^7$ |
| 35 | 0.125 | 2.5 | $3.3 \times 10^7$ |
| 36 | 0.247 | 5.0 | $8.8 \times 10^7$ |

EXAMPLES 37–40

Use of Strontium Ferrite Magnetic Carrier Doped with $Ge^{4+}$ in an Electrographic Process An electrographic device as described in U.S. Pat. No. 4,473,029, the teachings of which have been previously incorporated herein in their entirety, is employed in this example. A discharged area development system is used. The device has two electrostatic probes, one before a magnetic brush development station and one after the station to measure the voltage on an organic photoconductive film before and after development of an electrostatic image on the photoconductive film. The voltage of the photoconductor is set at −550 volts and the magnetic brush is maintained at 490 volts, for a total offset of +60 volts. The shell and photoconductor are set at a spacing of 0.020 inches, the core is rotated clockwise at 1000 rpm, and the shell is rotated at 15 rpm counter-clockwise. Through the charging station, the photoconductor is set to travel at a speed of 2 inches per second, while in the development section the photoconductor is set to travel at a speed of 5 inches per second. The nap density is 0.24 g/in$^2$. The carrier particles and toner used in Examples 37–40 are those prepared in Examples 5–8 hereinabove, respectively. The voltage on the photoconductor after charging and exposure to a step-wedge density target is measured by the first probe after development, the voltage on the photoconductor film in the developed areas is measured by the second probe. The development efficiency is calculated for a high density area by comparison of the pre- and post-exposure voltages on the photoconductor. After development, the charge on the photoconductive film is measured and the development efficiency for each example is calculated and shown in Table VIII.

TABLE VIII

| Development Efficiencies Obtained Using $Ge^{4+}$ Doped $SrFe_{12}O_{19}$ Carrier | | | |
|---|---|---|---|
| Example No. | x | $Ge^{4+}$ level pph | Rel DE |
| 38 | 0.027 | 0.25 | 2.08 |
| 39 | 0.053 | 0.50 | 2.68 |
| 40 | 0.106 | 1.0 | 2.43 |
| 41 | 0.158 | 1.5 | 3.49 |
| Comp. C | 0.0 | 0.0 | 1.00 |

Development efficiency is defined as a percentage of the potential difference between the photoreceptor in the developed image areas before and after toner development divided by the potential difference between the photoreceptor prior to development. For example, in the discharged area development configuration with a negative toner, if the photoconductor film voltage is −100 V and the magnetic brush is −500 V, the potential difference is 400 V prior to development. If during development, the film voltage is reduced by −200 V to −300 V in the image areas by the deposition of negative toner particles, the development efficiency would be 200 V/400 V, or 50%. The relative development efficiency (Rel DE) is calculated as a ratio of the measured development efficiency for a given example over the development efficiency of the developer employed in Comparative Example C (discussed hereinbelow) which uses the same carrier, except that it is not doped with $Ge^{4+}$ multi-valent metal ions.

COMPARATIVE EXAMPLE C

Example 37 is repeated, except that the commercially-prepared $SrFe_{12}O_{19}$ hard ferrite carrier described in Comparative Example A is employed as the carrier material. All other conditions including the toner concentration and charge are the same. The development efficiency is 15.5%, and the relative development efficiency would be 1.00 based on the definition of development efficiency described in Examples 37–40 above.

Barium and lead containing ferrites commonly referred to as magnetoplumbite ferrites which are substituted with multi-valent metal ions as described hereinabove are expected to achieve similar results when used as electrographic carrier materials.

"Electrography" and "electrographic" as used herein are broad terms that include image-forming processes involving the development of an electrostatic charge pattern formed on a surface with or without light exposure, and thus includes electrophotography and other similar processes.

Although the invention has been described in considerable detail, and with particular reference to preferred embodiments, it should be understood that variations and modifications to such embodiments can be made within the scope of the invention.

What is claimed is:

1. Carrier particles for use in the development of electrostatic latent images which comprise a hard magnetic material having a single-phase hexagonal crystal structure doped with at least one metal that, upon substitution of said metal into said crystal structure, produces a multi-valent ion of the formula $M^{n+}$, wherein n is an integer of at least 4.

2. The carrier particles of claim 1 which exhibit a coercivity of at least about 300 Oersteds when magnetically saturated and an induced magnetic moment of at least about 20 EMU/$\mu$m of carrier in an applied field of 1000 Oersteds.

3. The carrier particles of claim 1 which are surface coated with a resin layer.

4. The carrier particles of claim 3 wherein the layer is discontinuous.

5. The carrier particles of claim 3 wherein the resin is a mixture of polyvinylidene fluoride and polymethylmethacrylate.

6. The carrier particles of claim 3 wherein the resin is a silicone resin.

7. The carrier particles of claim 1 wherein the hard magnetic material is a hard magnetic ferrite selected from the group consisting of strontium ferrite, barium ferrite or lead ferrite.

8. The carrier particles of claim 1 wherein the hard magnetic material is strontium ferrite.

9. The carrier particles of claim 1 wherein n is 4 or 5.

10. The carrier particles of claim 1 wherein n is 4.

11. The carrier particles of claim 1 wherein the at least one metal is selected from the group consisting of antimony, arsenic, germanium, hafnium, molybdenum, niobium, silicon, tantalum, tellurium, tin, titanium, tungsten, vanadium, zirconium, and mixtures thereof.

12. The carrier particles of claim 1 wherein the at least one metal is selected from the group consisting of silicon, zirconium, tin, titanium, and mixtures thereof.

13. The carrier particles of claim 1 wherein the at least one metal is present in an amount of up to about 10 wt % based on total weight of the carrier particles.

14. A method for developing an electrostatic image comprising contacting the image with a two-component dry developer composition comprising charged toner particles and oppositely charged carrier particles according to claim 1.

15. Carrier particles for use in the development of electrostatic latent images that comprise a hard magnetic ferrite material having a single-phase hexagonal crystal structure and represented by the formula:

$$PFe_{12-x}M_xO_{19}$$

wherein:

P is selected from strontium, barium, or lead;

M is at least one metal selected from antimony, arsenic, germanium, hafnium, molybdenum, niobium, silicon, tantalum, tellurium, tin, titanium, tungsten, vanadium, zirconium, or mixtures thereof; and x is less than about 0.6.

16. The carrier particles of claim 15 which exhibit a coercivity of at least about 300 Oersteds when magnetically saturated and an induced magnetic moment of at least about 20 EMU/$\mu$m of carrier in an applied field of 1000 Oersteds.

17. The carrier particles of claim 15 which are surface coated with a resin layer.

18. The carrier particles of claim 17 wherein the layer is discontinuous.

19. The carrier particles of claim 17 wherein the resin is a mixture of polyvinylidene fluoride and polymethylmethacrylate.

20. The carrier particles of claim 17 wherein the resin is a silicone resin.

21. The carrier particles of claim 15 wherein P is strontium.

22. The carrier particles of claim 15 wherein x is less than about 0.3.

23. The carrier particles of claim 15 wherein the at least one metal is selected from the group consisting of silicon, zirconium, tin, titanium, and mixtures thereof.

24. A method for developing an electrostatic image comprising contacting the image with a two-component dry developer composition comprising charged toner particles and oppositely charged carrier particles according to claim 15.

25. An electrostatic dry developer composition for use in the development of electrostatic latent images which comprises a mixture of charged toner particles and oppositely charged carrier particles, the carrier particles comprising a hard magnetic material having a single-phase hexagonal crystal structure doped with at least one metal that, upon substitution of said metal into said crystal structure, produces a multi-valent ion of the formula $M^{n+}$, wherein n is an integer of at least 4.

26. The developer of claim 25 wherein the carrier particles exhibit a coercivity of at least about 300 Oersteds when magnetically saturated and an induced magnetic moment of at least about 20 EMU/gm of carrier in an applied field of 1000 Oersteds.

27. The developer of claim 25 wherein the carrier particles are surface coated with a resin layer.

28. The developer of claim 27 wherein the layer is discontinuous.

29. The developer of claim 27 wherein the resin is a mixture of polyvinylidene fluoride and polymethylmethacrylate.

30. The developer of claim 27 wherein the resin is a silicone resin.

31. The developer of claim 25 wherein the hard magnetic material is a hard magnetic ferrite selected from the group consisting of strontium ferrite, barium ferrite or lead ferrite.

32. The developer of claim 25 wherein the hard magnetic material is strontium ferrite.

33. The developer of claim 25 wherein n is 4 or 5.

34. The developer of claim 25 wherein n is 4.

35. The developer of claim 25 wherein the at least one metal is selected from the group consisting of antimony, arsenic, germanium, hafnium, molybdenum, niobium, silicon, tantalum, tellurium, tin, titanium, tungsten, vanadium, zirconium, and mixtures thereof.

36. The developer of claim 25 wherein the at least one metal is selected from the group consisting of silicon, zirconium, tin, titanium, and mixtures thereof.

37. The developer of claim 25 wherein the at least one metal is present in an amount of up to about 10 wt % based on total weight of the carrier particles.

38. A method for developing an electrostatic image comprising contacting the image with a two-component dry developer composition comprising charged toner particles and oppositely charged carrier particles according to claim 25.

39. An electrostatic two-component dry developer composition for use in the development of electrostatic latent images which comprises a mixture of charged toner particles and oppositely charged carrier particles, the carrier particles comprising a hard magnetic ferrite material having a single phase hexagonal crystal structure and represented by the formula:

$$PFe_{12-x}M_xO_{19}$$

wherein:

P is selected from strontium, barium, or lead;

M is at least one metal selected from antimony, arsenic, germanium, hafnium, molybdenum, niobium, silicon, tantalum, tellurium, tin, titanium, tungsten, vanadium, zirconium, or mixtures thereof; and x is less than about 0.6.

40. The developer of claim 39 wherein the carrier particles exhibit a coercivity of at least about 300 Oersteds when magnetically saturated and an induced magnetic moment of at least about 20 EMU/gm of carrier in an applied field of 1000 Oersteds.

41. The developer of claim 39 which are surface coated with a resin layer.

42. The developer of claim 41 wherein the layer is discontinuous.

43. The developer of claim 41 wherein the resin is a mixture of polyvinylidene fluoride and polymethylmethacrylate.

44. The developer of claim 41 wherein the resin is a silicone resin.

45. The developer of claim 39 wherein P is strontium.

46. The developer of claim 39 wherein x is less than about 0.3.

47. The developer of claim 39 wherein the at least one metal is selected from the group consisting of silicon, zirconium, tin, titanium, and mixtures thereof.

48. A method for developing an electrostatic image comprising contacting the image with a two-component dry developer composition comprising charged toner particles and oppositely charged carrier particles according to claim 39.

49. An electrostatic single-component dry developer for use in the development of electrostatic latent images which comprises a composite of a binder and a hard magnetic material having a single-phase hexagonal crystal structure doped with at least one metal that, upon substitution of said metal into said crystal structure, produces a multi-valent ion of the formula $M^{n+}$, wherein n is an integer of at least 4.

50. The developer of claim 49 wherein the magnetic material exhibits a coercivity of at least about 300 Oersteds when magnetically saturated and an induced magnetic moment of at least about 20 EMU/gm of carrier in an applied field of 1000 Oersteds.

51. The developer of claim 49 wherein the hard magnetic material is strontium ferrite.

52. The developer of claim 49 wherein the at least one metal is selected from the group consisting of antimony, arsenic, germanium, hafnium, molybdenum, niobium, silicon, tantalum, tellurium, tin, titanium, tungsten, vanadium, zirconium, and mixtures thereof.

53. The developer of claim 49 wherein the at least one metal is selected from the group consisting of silicon, zirconium, tin, titanium, and mixtures thereof.

54. The developer of claim 49 wherein n is 4 or 5.

55. The developer of claim 49 wherein n is 4.

56. A method for developing an electrostatic image comprising contacting the image with a single-component dry developer composition comprising charged toner particles and oppositely charged carrier particles according to claim 49.

57. An electrostatic single-component dry developer for use in the development of electrostatic latent images which comprises a composite of a binder and a hard magnetic material having a single-phase hexagonal crystal structure and represented by the formula:

$$PFe_{12-x}M_xO_{19}$$

wherein:

P is selected from strontium, barium, or lead;

M is at least one metal selected from antimony, arsenic, germanium, hafnium, molybdenum, niobium, silicon, tantalum, tellurium, tin, titanium, tungsten, vanadium, zirconium, or mixtures thereof; and x is less than about 0.6.

58. The developer of claim 57 wherein the magnetic material exhibits a coercivity of at least about 300 Oersteds when magnetically saturated and an induced magnetic moment of at least about 20 EMU/gm of carrier in an applied field of 1000 Oersteds.

59. The developer of claim 57 wherein the hard magnetic material is strontium ferrite.

60. The developer of claim 57 wherein x is less than about 0.3.

61. The developer of claim 57 wherein the at least one metal is selected from the group consisting of silicon, zirconium, tin, titanium, and mixtures thereof.

62. A method for developing an electrostatic image comprising contacting the image with a single-component dry developer composition comprising charged toner particles and oppositely charged carrier particles according to claim 57.

* * * * *